US005211425A

United States Patent [19]

Glushakov

[11] Patent Number: 5,211,425

[45] Date of Patent: May 18, 1993

[54] COLLECTION UNIT FOR STORAGE OF FLAT ITEMS

[76] Inventor: Vladislav G. Glushakov, per. Vasnetsova, d.15, kv17, Moscow, U.S.S.R., 129090

[21] Appl. No.: 807,865

[22] PCT Filed: May 13, 1991

[86] PCT No.: PCT/SU91/00092

§ 371 Date: Feb. 6, 1992

§ 102(e) Date: Feb. 6, 1992

[87] PCT Pub. No.: WO91/17896

PCT Pub. Date: Nov. 28, 1991

[30] Foreign Application Priority Data

May 15, 1990 [SU] U.S.S.R. ..... 4839287[I]

[51] Int. Cl.[5] ..... B42D 3/00

[52] U.S. Cl. ..... 281/45; 281/2; 281/31; 283/38

[58] Field of Search ..... 281/2, 5, 15.1, 31, 281/45; 283/2, 36, 37, 38

[56] References Cited

U.S. PATENT DOCUMENTS 2,110,709 3/1938 Limbach .
4,964,656 10/1990 Prentice ..... 281/31 X

FOREIGN PATENT DOCUMENTS 2551095 5/1977 Fed. Rep. of Germany .
1461582 12/1966 France .
400098 10/1933 United Kingdom .
454336 9/1936 United Kingdom .

*Primary Examiner*—Mark Rosenbaum
*Assistant Examiner*—Willmon Fridie, Jr.
*Attorney, Agent, or Firm*—Collard & Roe

[57] ABSTRACT

A unit for storing a flat item including a holder of the item in the form of a booklet with one of its pages being a pocket or packet for holding the item. The unit also includes an identifying insert card removably connected to the booklet. An upper part of the card extends beyond the booklet and has markings for identifying the item.

1 Claim, 1 Drawing Sheet

COLLECTION UNIT FOR STORAGE OF FLAT ITEMS

FIELD OF THE ART

The invention relates to means for keeping documents and collection items and, more particularly, to a collection unit for storage of flat items.

PRIOR ART

Known in the prior art is the design of an album for keeping collection materials such as printed matter with a two-faced picture, e.g. bonds. For this purpose the album pages are made double in the form of transparent packets for keeping collection items. This provides for their preservation in handling the collection.

As a rule, collectioners draw their information from catalogues featuring pictures of the collection items, their price, category of rarity, etc. Descriptions of collection items, e.g. bonds are contained in multitudinous single official publications, mostly navailable to collectioners.

Lack of facilities for keeping collection articles and providing them at the same time with appropriate information forced collectioners to turn to independent search for information and making up reference materials, excerpts from descriptions of collection items and combining them with read collection items directly in the album or in specially adapted envelopes, packets and similar makeshift means for individual joint keeping of collection and reference materials.

Thus, there is a nonsatisfied demand for collectioners' aids intended to combine the functions of keeping the collection material and informing the collectioners. In the case of collection of bonds where the number of collection items is limited to a few hundred pieces and where comprehensive information about them is valuable but scarce, it is possible and expedient to turn to individual keeping means also providing appropriate information.

Besides, when a collection is a combination of homogeneous means of individual storage, a need arises for classification of the storage means proper and providing for search and selection of the required items from the collection on the basis of classification features established both by the universally adopted classification systems and, if necessary, by the collectioner himself. The means for individual keeping of collection material used nowadays fail to provide for classification, search and selection of required materials from the collection.

Known in the prior art is a collection unit for storage of flat items (U.S. Pat. No. 2,110,709) comprising item holder with a pocket for said item. The pocket has through openings. The flat item, e.g. a stamp, is kept in the pocket in a transparent case. The unit also comprises an inserted card intended to keep the case with stamp in the unit in the required position, and a means for the separable joint between the holder and inserted card. A part of the inserted card protrudes beyond the contour of the holder and serves for identification of the stamp. One opening of the pocket serves for looking at the stamp and the other one, for entering information about said stamp.

A substantial disadvantage of such a unit lies in that it does not contain information on the collection item, prepared in advance. Besides, the unit falls to provide two-sided visual access to the item so that the item must be taken out of the case for this purpose, which is inconvenient and may involve damage to the item. A disadvantage of this unit also lies in that it denies the possibility of taking out one or more units possessing certain classification features which individualize a concrete item and its belonging to groups, classes, etc.

DISCLOSURE OF THE INVENTION

The main object of the present invention lies in providing a unit for collection storage of a flat piece whose design would ensure two-sided visual access to the item, provide a certain information about it and permit prompt picking of the unit from the collection.

This object is achieved by providing a unit for collection storage of a flat item comprising an item holder, a pocket for the item, an inserted card protruding partly beyond the contour of the holder and a means for jointing separably the holder and the inserted card wherein, according to the invention, the holder has the form of a booklet used as a carrier of information on the collection item, one of the booklet pages serving as a pocket for the item and made of a transparent material, and the protruding part of the card having markings for identifying and picking out at least one unit from the collection.

The disclosed design of the unit increases the degree of informativeness by providing the booklet with information and reference material about, for example, a bond including reproduction of both its sides, official description, historical references, catalogue numbers and other pertinent data.

In the preferable embodiment of the invention the card markings rae made in the form of horizontal rows of holes arranged one above another.

Such markings permit encoding the collection pieces by cutting out connectors between the rows of holes and picking out the required items by means of, say, a knitting needle.

BRIEF DESCRIPTION OF DRAWINGS other objects and advantages of the present invention will be understood from the following detailed description of its embodiment and appended drawings in which.

BEST MODE OF CARRYING OUT THE INVENTION

Figure 1:
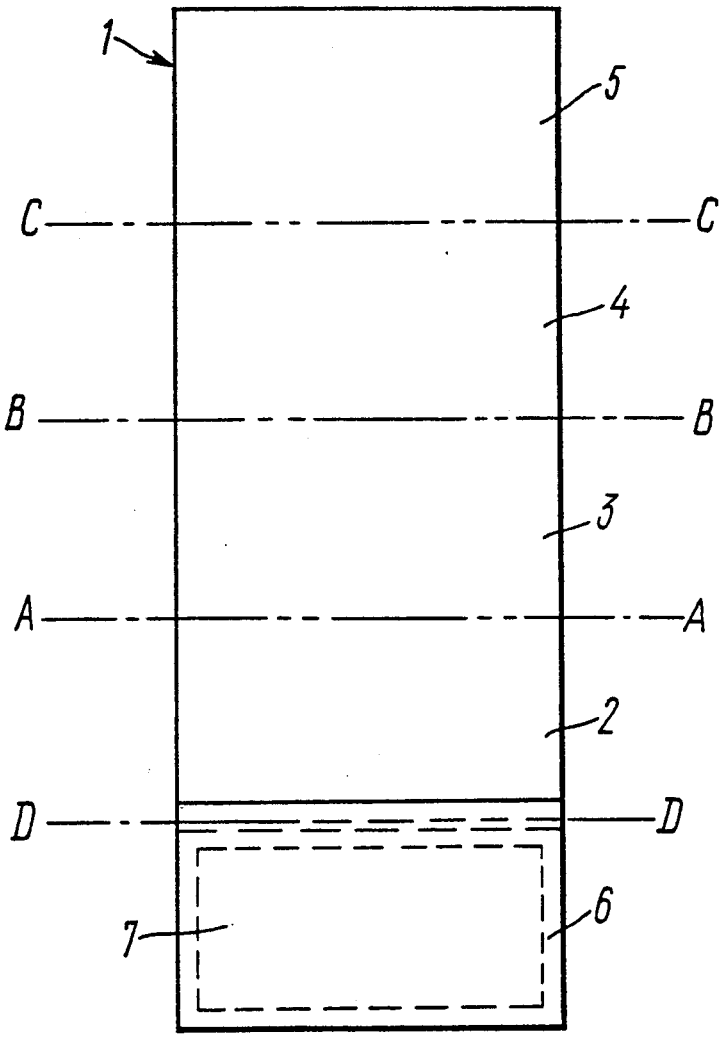
FIG. 1 is a schematic diagram of the unit according to the invention (title side)

The unit for collection keeping of a flat item comprises a holder 1 (FIG. 1) in the form of a booklet with pictures of the collection item and an information reference text. The booklet pages 2, 3, 4, 5, 6 are formed by folding a printed sheet along parallel lines AA, BB, CC, bending it upward along lines AA and BB and downward along line CC relative to the plane of the sheet illustrated in FIG. 1. Page 6 has the form of a pocket or packet of a transparent material, e.g. polyethylene, connected by separable joint, for instance with glue, with booklet page 2. For this purpose one wall of the packet 6 on its open side is made longer than the other one for coating it with glue and connecting it with page 2. Pocket 6 accommodates a collection item 7, e.g. a bond.

In the storage position the packet 6 is inserted into the booklet by bending it along line DD on the edge of booklet page 2.

When the booklet is folded in this manner, pages 3 and 2 play the role of first and last page covers, respectively. The pocket 6 with the bond 7 is placed on the third cover page. Pages 4 and 5 are contained inside the booklet.

Figure 2:
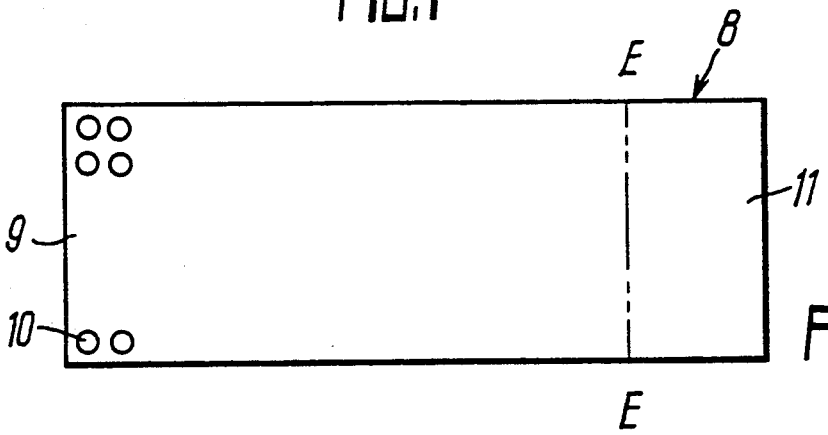
FIG. 2 is an inserted card.

The unit also contains an inserted card 8 (FIG. 2) whose upper part 9 is marked in the form of horizontal rows of holes 10 arranged one above another. The lower part 11 of the card 8 is bent along line EE located between booklet pages 4,5 or 3,4.

With the aid of said separable joint, the card 8 permits taking the unit out of the collection with the aid of a knitting needle, just as it is done with cards having edge perforations. For this purpose the length of the card 8 is selected so that, when it is connected with the booklet in the above-mentioned manner, the upper part 9 of the card 8 would protrude from the booklet. The width of the card 8 shall not exceed that of any page 2,3,4,5,6, of the booklet.

The card 8 does not contain any previously introduced information on a concrete collection item and both sides of said card may be used by the collectioner for entering his own information such as date of acquisition, price, etc. The basic function of the card 8,—a speedy search for a concrete collection material—is ensured with the aid of rows of holes 10 with connectors which, being either cut out or left in position, make it possible to encode the catalogue and other data on the concrete items stored.

The collection item may be either an original or its copy which enhances the convenience of studying the collection items when comparing their designs and when the original bonds are absent.

INDUSTRIAL APPLICABILITY

The invention can prove useful for keeping of bonds and similar collection items.

I claim:

1. A collection unit for storing a flat item belonging to a collection, comprising:

a holder including several pages formed as a booklet containing information about the item, one of said pages being a transparent pocket to receive and hold the item; and an insert card removably connected to said holder including a tab extending beyond said pages and having markings for identifying the item and allowing similarly marked tabs to be selected and removed from the collection wherein said markings comprise rows of holes punched into said tab arranged adjacent to each other.

* * * * *